US008672129B2

(12) United States Patent
Glass et al.

(10) Patent No.: US 8,672,129 B2
(45) Date of Patent: Mar. 18, 2014

(54) MULTICARD HOLDER

(75) Inventors: Brett R. Glass, Overland Park, KS (US); Nicole E. Glass, Overland Park, KS (US)

(73) Assignee: Gift Card Impressions, LLC, Kansas City, MO (US)

( * ) Notice: Subject to any disclaimer, the term of this patent is extended or adjusted under 35 U.S.C. 154(b) by 0 days.

(21) Appl. No.: 13/594,863

(22) Filed: Aug. 26, 2012

(65) Prior Publication Data

US 2013/0220875 A1 Aug. 29, 2013

Related U.S. Application Data

(60) Provisional application No. 61/527,135, filed on Aug. 25, 2011.

(51) Int. Cl.
*B65D 85/00* (2006.01)
*G09F 1/00* (2006.01)

(52) U.S. Cl.
USPC ..... 206/461; 229/67.4; 40/124.06

(58) Field of Classification Search
USPC ..... 206/232, 39.3, 39.4, 39.6, 461, 466; 229/67.1, 67.3, 67.4, 92.8; 40/124.06
See application file for complete search history.

(56) References Cited

U.S. PATENT DOCUMENTS

| | | | | |
|---|---|---|---|---|
| 161,506 | A * | 3/1875 | Grinsted et al. | 229/87.01 |
| 2,016,258 | A * | 10/1935 | Schmitz | 229/67.3 |
| 5,593,086 | A * | 1/1997 | Ho | 229/67.3 |
| 7,219,829 | B2 * | 5/2007 | Treat | 229/92.8 |
| 7,222,446 | B2 * | 5/2007 | Foster | 40/124.06 |
| 2008/0223907 | A1 * | 9/2008 | Su | 229/67.3 |

* cited by examiner

*Primary Examiner* — David Fidei
(74) *Attorney, Agent, or Firm* — Polsinelli PC

(57) ABSTRACT

A card holder for holding a plurality of transaction cards, such as a gift cards, that minimizes display rack space occupied by the holder when it is on display for sale, but that expands to hold multiple gift cards.

5 Claims, 3 Drawing Sheets

MULTICARD HOLDER

CROSS REFERENCE TO RELATED APPLICATIONS

This application claims the benefit of the prior filed, co-pending provisional application Ser. No. 61/527,135, filed Aug. 25, 2011, incorporated by reference herein.

BACKGROUND OF THE INVENTION

This invention relates generally to gift card holders and more particularly to a gift card organizer that expands to hold multiple gift cards.

Transaction cards, stored value cards, or gift cards, as they are commonly called based upon their intended use, have become popular gifts. Gift cards typically comprise a stored value card whereby a certain cash equivalent value is encoded upon a magnet strip applied to the surface of the card. This stored value may be determined by the vendor prior to packaging and display for sale or, more commonly, is selected at the point of sale by the purchaser and loaded by the cashier using a magnet card reader/writer. While popular, gift cards are typically provided with a generic and impersonal design, typically identifying the associated merchant for which the card may be used to purchase merchandise, and therefore are not personalized in view of the intended recipient.

Gift cards are often presented for sale on display racks in stores, each card or packet of cards being hung upon a display stand peg. A given area of a store will only support a certain number and size of display stands, given store traffic and other considerations, which makes allocation of display space an important marketing decision that may require selecting only certain high selling cards for display. Display of other items in the same store area will typically reduce the substantially finite space available for displaying gift cards and gift card packets.

In addition to the above considerations, gift card packets must fit within a set, allocated space in pre-existing displays. A gift card packet must not exceed 5.25" tall and 4" wide. These dimensions are an industry standard and are typically non-negotiable. In order to properly hang each gift card packet, the packet typically includes a J-hook hole (sombrero cut) with the exact dimensions of 1.875" wide by 0.5" high and be placed 0.1875" from the top of the packet. Presently, the above requirements pertain to approximately 95% of all gift cards and gift card packets that are sold at retail.

What is needed, therefore, is a device that increases the value of a gift comprising a gift card, relative to the price paid by the purchaser, and increases the value and price relative to space for the merchant displaying and selling embodiments thereof.

BRIEF DESCRIPTION OF THE INVENTION

The purpose of this invention is to provide a holder for holding transaction cards, such as gift cards, in a manner that minimizes space occupied by the holder when it is on display for sale, but that expands to hold multiple gift cards when in use after sale and removal from display.

An embodiment of a card holder according to the present invention may include a shell portion comprising a front wall, a back wall, a pleated bottom wall extending between lower margins of the front wall and the back wall, a first pleated side wall extending between first side margins of the front and the back wall and a second pleated side wall extending between second side margins of the front wall and the back wall so that the first and second side walls are spaced apart at substantially the width of the holder. Pleats in the first side wall are opposed to, and substantially aligned with, pleats in the second side wall and dividers are positioned to extend between the first side wall and said second side wall. Typically, one divider is positioned at each pair of aligned, opposed pleats. A closure flap extends upward from the upper margin of the back wall.

The holder may further include a header panel attached to a rear surface of the back wall and extending upward therefrom. In certain embodiments, the header is attached to the rear surface via tabs projecting downward from a lower margin of the header panel. The tabs may adjoin (and be separated from) the lower margin along lines of perforations between each tab the proximate portion of the lower margin of the header panel. The header panel may thereby be removed from the holder by tearing or otherwise separating along the perforations.

Other advantages of the invention will become apparent from the following description taken in connection with the accompanying drawings, wherein is set forth by way of illustration and example an embodiment of the present invention.

DETAILED DESCRIPTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
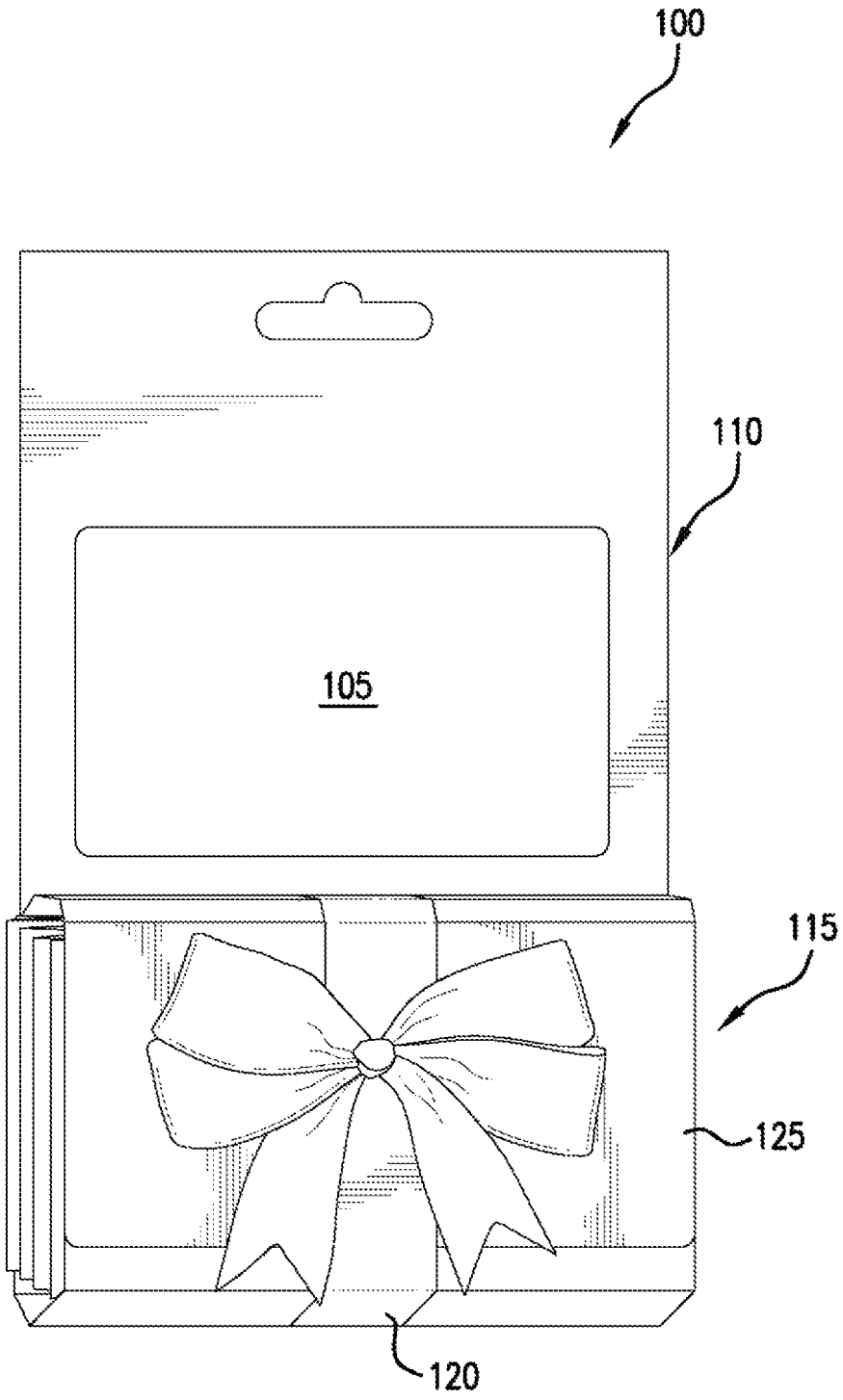
FIG. 1 is a front perspective view of a multicard holder including a header panel, holder body and closure band.
Figure 2:
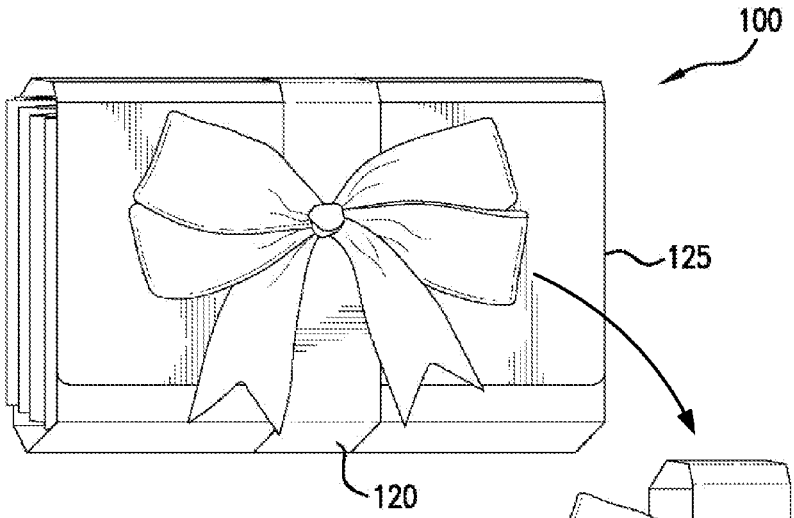
FIG. 2 is a front perspective view of the holder with the header panel removed.
Figure 3:
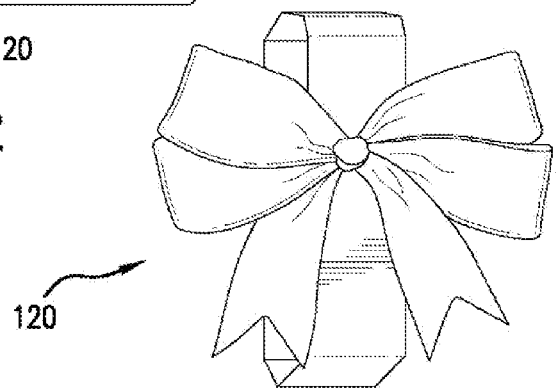
FIG. 3 is a front perspective view the closure band.
Figure 4:
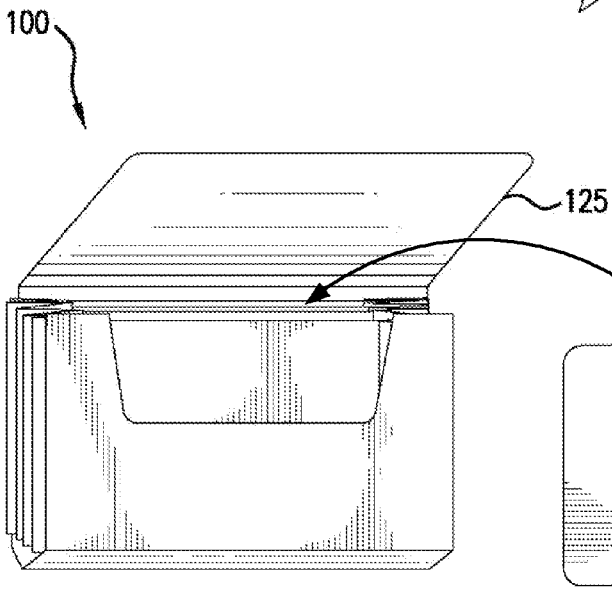
FIG. 4 is a front perspective view of the holder showing the flap opened for receiving a gift card therein.
Figure 5:
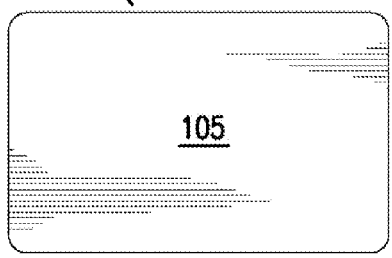
FIG. 5 is a front view of a gift card.
Figure 6:
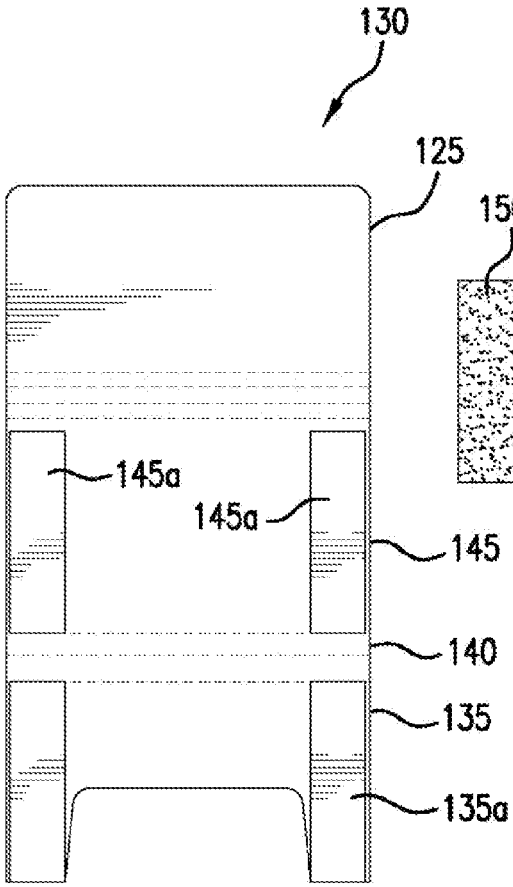
FIG. 6 is a plan view of the layout of an unassembled front wall, bottom wall, back wall and flap of a holder.

With reference to the figures, FIGS. 1 through 9 illustrate one or more embodiments of a multicard holder 100 for holding transaction cards such as a gift cards 105. FIG. 1 is a front perspective view of a multicard holder including a header panel 110, holder body 115 and closure band 120. FIG. 2 is a front perspective view of the holder 100 with the header panel 110 removed. FIG. 3 is a front perspective view the closure band 120. FIG. 4 is a front perspective view of the holder 100 showing the flap 125 opened for receiving a gift card therein. FIG. 5 is a front view of a gift card.

Figure 7:
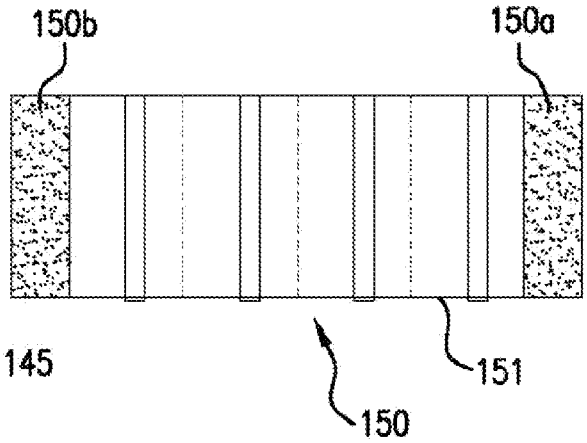
FIG. 7 is a plan view of the layout of an unassembled side wall.

FIGS. 6 through 9 show plan views of diecut elements of an unassembled holder 100 including a shell portion 130, typically comprising plastic or other flexible, resilient material, that includes a front wall 135, a bottom wall 140, a back wall 145 and the previously referenced flap 125. FIG. 7 is a plan view of the layout of an unassembled accordion-pleated side wall 150. The side walls 150, of which there are two—one wall for each side of the holder 100—comprise plastic or other flexible, resilient material, and include front and back tab portions, 150*a* and 150*b* respectively. The front tab 150*a* of each side wall 150 is adhered to an inside surface of the front wall 135 as indicated by reference number 135*a*, and the back tab 150*b* of each side wall 150 is adhered to an inside surface of the back wall 145 as indicated by reference number 145*a*.

Figure 8:
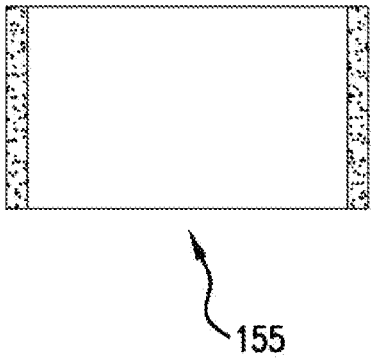
FIG. 8 is a plan view of a divider.

Each side wall 150 comprises multiple accordion pleats 151 and dividers 155 are adhered to and between aligned pleats 151 in opposing left and right side walls 150 of a holder 100. FIG. 8 is a plan view of a divider 155. Gift cards 105 may be organized within the holder 105 by segregating gift cards 105 between various dividers 155.

Figure 9:
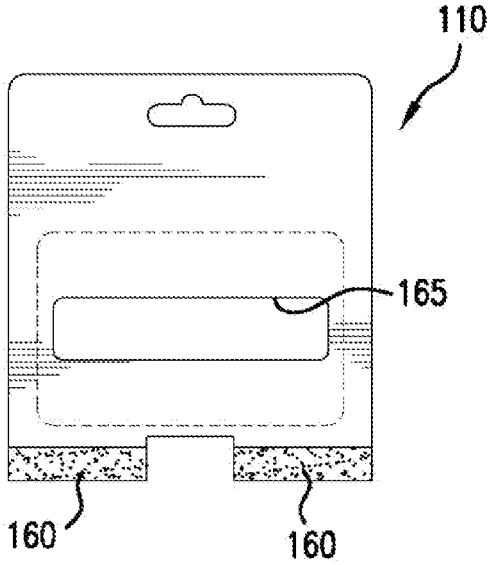
FIG. 9 is a plan view of a header panel.

FIG. 9 is a plan view of a header panel 110. The header panel 110 includes tabs 160 that project downward from the main body of the header panel 110. Adhesive is applied to forward surfaces of the tabs 160 and the tabs 160 are adhered to the back wall of the holder 100 in order to attach the header panel 110 to the holder 100. An aperture 165 may be provided in the header panel 110 so that indicia on the back surface of a gift card 105 removably attached to the header panel 110 may be read or accessed through the aperture 165.

Having thus described the invention, what is claimed as new and desired to be secured by Letters Patent is:

1. A card holder comprising:

a shell portion comprising a front wall, a back wall, a pleated bottom wall extending between lower margins of said front wall and said back wall, a first pleated side wall extending between first side margins of said front and said back wall, a second pleated side wall extending between second side margins of said front wall and said back wall, said first and second side walls spaced apart, pleats in said first side wall substantially aligned with pleats in said second side wall, a flap extending upward from an upper margin of said back wall;

a header panel attached to a rear surface of said back wall and extending upward therefrom, wherein said header is attached to said rear surface via tabs projecting downward from a lower margin of said header panel and wherein said tabs adjoin said lower margin along lines of perforations therebetween; and dividers positioned and extending between said first side wall and said second side wall.

2. The card holder of claim 1 further comprising a closure band.

3. The card holder of claim 2, wherein the closure band engages the shell portion and passes between the tabs projecting downward from the header panel.

4. The card holder of claim 1, wherein the header panel engages a gift card.

5. The card holder of claim 4, wherein the header panel defines an aperture, and wherein indicia on a surface of the gift card engaged to the header panel is viewable through the aperture.

* * * * *